US007004248B2

(12) United States Patent
Hoffman et al.

(10) Patent No.: US 7,004,248 B2
(45) Date of Patent: Feb. 28, 2006

(54) HIGH EXPANSION NON-ELASTOMERIC STRADDLE TOOL

(75) Inventors: Corey Hoffman, Magnolia, TX (US); Paul Wilson, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/339,375

(22) Filed: Jan. 9, 2003

(65) Prior Publication Data

US 2004/0134659 A1 Jul. 15, 2004

(51) Int. Cl.
*E21B 33/128* (2006.01)

(52) U.S. Cl. ..... 166/191; 166/188; 166/202; 166/387

(58) Field of Classification Search ..... 166/191, 166/188, 183, 202, 387
See application file for complete search history.

(56) References Cited

U.S. PATENT DOCUMENTS

| | | | | |
|---|---|---|---|---|
| 1,495,807 | A * | 5/1924 | Sanders | 417/552 |
| 2,187,480 | A * | 1/1940 | Baker | 166/116 |
| 2,667,117 | A | 1/1954 | Millard et al. | |
| 2,903,066 | A * | 9/1959 | Brown | 166/313 |
| 3,115,187 | A * | 12/1963 | Brown | 166/316 |
| 3,955,625 | A * | 5/1976 | Hughes et al. | 166/202 |
| 4,138,939 | A | 2/1979 | Feld | |
| 4,401,017 | A | 8/1983 | Feld | |
| 4,491,178 | A * | 1/1985 | Terrell et al. | 166/192 |
| 4,953,452 | A | 9/1990 | Tarlow | |
| 5,361,836 | A | 11/1994 | Sorem et al. | |
| 5,618,169 | A * | 4/1997 | Smith | 417/554 |
| 5,678,635 | A | 10/1997 | Dunlap et al. | |
| 6,065,544 | A | 5/2000 | Holbert | |
| 6,253,856 | B1 * | 7/2001 | Ingram et al. | 166/374 |
| 6,257,339 | B1 | 7/2001 | Haugen et al. | |
| 6,443,458 | B1 | 9/2002 | Jansch | |
| 6,547,002 | B1 | 4/2003 | Bailey et al. | |
| 6,554,076 | B1 | 4/2003 | Guillory et al. | |
| 6,578,638 | B1 | 6/2003 | Guillory et al. | |
| 6,612,372 | B1 | 9/2003 | Freiheit et al. | |
| 6,668,930 | B1 | 12/2003 | Hoffman | |
| 2002/0011341 | A1 | 1/2002 | Ingram et al. | |
| 2002/0195248 | A1 | 12/2002 | Ingram et al. | |

(Continued)

FOREIGN PATENT DOCUMENTS

WO 97/30266 8/1997

OTHER PUBLICATIONS

EP Search Report, Application No. EP 04 25 0046.2, dated Mar. 15, 2004.

(Continued)

*Primary Examiner*—David Bagnell
*Assistant Examiner*—Giovanna M. Collins
(74) *Attorney, Agent, or Firm*—Patterson & Sheridan, LLP

(57) ABSTRACT

The present invention involves a pack-off system for use in packing off an area of interest within a wellbore. The pack-off system comprises at least two packing elements disposed on a tubular body. The packing elements of the present invention comprise overlapping leaves which are pivotally mounted on the tubular body. The present invention further involves a method for using the pack-off system, wherein the packing elements are placed adjacent to an area of interest within a wellbore. The overlapping leaves of the packing elements are extended radially to effectively obstruct fluid flow in the annular space between the outermost portions of the packing elements and the wellbore. The bulk of the fluid introduced into the wellbore is trapped between the packing elements and is thereby forced into the area of interest.

23 Claims, 5 Drawing Sheets

U.S. PATENT DOCUMENTS

| | | | |
|---|---|---|---|
| 2003/0037931 | A1 | 2/2003 | Coon |
| 2003/0047322 | A1 | 3/2003 | Maquire et al. |
| 2003/0047323 | A1 | 3/2003 | Jackson et al. |
| 2003/0121671 | A1 | 7/2003 | Bailey et al. |
| 2003/0131988 | A1 | 7/2003 | Wilson et al. |
| 2003/0132008 | A1 | 7/2003 | Hirth et al. |
| 2004/0055758 | A1 * | 3/2004 | Brezinski et al. ..... 166/384 |

OTHER PUBLICATIONS

U.S. Appl. No. 10/268,007 filed on Oct. 9, 2002.

* cited by examiner

HIGH EXPANSION NON-ELASTOMERIC STRADDLE TOOL

BACKGROUND OF THE INVENTION

1. Field of the Invention

The present invention generally relates to downhole tools for use in a hydrocarbon wellbore. More particularly, this invention relates to an apparatus useful in performing a wellbore treatment operation. More particularly still, this invention relates to a pack-off system for effectively isolating an area of interest within a wellbore so that a treatment fluid may be pumped into the pack-off system and into the area of interest, and a method for using the same.

2. Description of the Related Art

In the drilling of oil and gas wells, a wellbore is formed using a drill bit that is urged downwardly at a lower end of a drill string. When the well is drilled to a first designated depth, a first string of casing is run into the wellbore. The first string of casing is hung from the surface, and then cement is circulated into the annulus behind the casing. Typically, the well is drilled to a second designated depth after the first string of casing is set in the wellbore. A second string of casing, or liner, is run into the wellbore to the second designated depth. This process may be repeated with additional liner strings until the well has been drilled to total depth. In this manner, wells are typically formed with two or more strings of casing having an ever-decreasing diameter.

After a well has been drilled, it is desirable to provide a flow path for hydrocarbons from the surrounding formation into the newly formed wellbore. Therefore, after all of the casing has been set, perforations are shot through a wall of the liner string at a depth which equates to the anticipated depth of hydrocarbons. Alternatively, a liner having preformed slots may be run into the hole as casing. Alternatively still, a lower portion of the wellbore may remain uncased so that the formation and fluids residing therein remain exposed to the wellbore.

In many instances, either before or after production has begun, it is desirable to inject a treating fluid into the surrounding formation at particular depths. Such a depth is sometimes referred to as an area of interest in a formation. Often perforations formed within a wellbore to recover hydrocarbons from the surrounding formation become obstructed partially or completely. In such a situation, treating fluids under pressure may be introduced into the wellbore so that treating fluid is forced into the perforations and into the surrounding formation. The treating fluid removes the obstructions from the perforations, unclogging the perforations and repairing the wellbore so that hydrocarbons may again be recovered through the formation. Various treating fluids are known, such as acids, polymers, and fracturing fluids. Methods of injection of treating fluid into the wellbore are known as well treatment operations.

To perform a well treatment operation, the treating fluid must be introduced into the wellbore at a pressure sufficient to overcome the pressure created by the hydrocarbons exiting from the perforations in the wellbore during the recovery operation. Treatment fluids are expensive, and decreasing the area through which the treating fluid must flow decreases the amount of pressure necessary to overcome the pressure created by the exiting hydrocarbons. Therefore, it is often desirable to "straddle" the area of interest within the wellbore to decrease the volume of the treating fluid necessary to perform the well treatment operation. This is typically done by "packing off" the wellbore above and below the area of interest. To accomplish this, a first packing element is set above the area of interest, and a second packing element is set below the area of interest. Treating fluids can then be injected under pressure into the formation between the two set packing elements.

A variety of pack-off systems are available which include two selectively-settable and spaced-apart packing elements. Several such prior art systems use a piston or pistons movable in response to hydraulic pressure in order to actuate the setting apparatus for the packing elements. A different type of straddle pack-off system is disclosed in U.S. Pat. No. 6,253,856 B1, which is incorporated in its entirety herein by reference. This pack-off system does not require mechanical pulling and/or pushing in order to actuate the packing elements; rather, the packing elements are set through a combination of hydraulic and mechanical pressure. A specialized collar for use with the pack-off system of U.S. Pat. No. 6,253,856 is disclosed in the co-pending application "Fracturing Port Collar for Wellbore Pack-Off System, and Method for Using the Same," U.S. Ser. No. 10/073,685, which is also incorporated herein by reference. The packing elements of the current invention may be used in combination with the any of the above pack-off systems, as well as in any other prior art pack-off systems which apply compressive force to the packing elements to expand the elements radially.

The packing elements of the prior art pack-off systems are expanded radially to sealably engage the inner diameter of the casing. These packing elements completely obstruct the flow of fluid through the annular space between the pack-off system and the casing. To accomplish the complete obstruction of fluid flow through the annular space between the pack-off system and the casing, the packing elements of the prior art are either inflatable or elastomeric. The inflatable packing elements are radially expanded hydraulically downhole by introducing fluid into the packing elements themselves. Elastomeric packing elements, which are made of an elastomeric material such as rubber, are radially expanded downhole by mechanical and/or hydraulic force. The mechanical force is essentially axial force which is exerted upward and downward on each packing element, thereby compressing each elastomeric packing element and forcing the packing element radially outward. Each type of packing element may be actuated by mechanical or hydraulic force or a combination of mechanical and hydraulic force.

Often, multiple areas of interest must be treated within a wellbore. To move the pack-off system to a second area of interest within the wellbore, the packing elements must experience a decrease in diameter by the release of compressive forces upon the packing elements. The pack-off system is then moved to another location within the wellbore so that the packing elements are again located above and below the second area of interest. Next, the packing elements must again be expanded radially to sealably engage the inner diameter of the casing above and below the second area of interest. This process is repeated to treat subsequent areas of interest within a wellbore.

While the packing elements of the prior art pack-off systems provide the advantage of completely sealing off fluid flow through the annular space between the pack-off system and the casing, these packing elements do possess certain disadvantages. Both elastomeric and inflatable packing elements lack durability. Specifically, upon treatment of multiple areas of interest, elastomeric and inflatable packing elements often lose strength and durability due to the stress exerted upon the packing elements during every compression and subsequent decompression required to treat each area of interest. Loss of strength and durability in the packing elements decreases the ability of the packing elements to sealably engage the casing to isolate subsequent areas of interest to perform the packing operation. Accordingly, the packing elements must often be replaced in order to treat more areas of interest. The pack-off system must be removed from the wellbore to replace the defective packing elements with new packing elements when the effectiveness of the packing elements is decreased. Then, the pack-off system must again be run into the wellbore. Every separate run-in of the pack-off system necessary to maintain the packing elements in good repair is extremely expensive due to labor and material costs.

Therefore, a need exists for durable packing elements for use in a pack-off system which are capable of treating multiple areas of interest within the wellbore with only one run-in of the pack-off system. There is a need for packing elements for use in a pack-off system which may be moved within the wellbore to treat multiple areas of interest while the packing elements are set. Decreasing the amount of times the packing elements must be compressed and decompressed allows treatment of multiple areas of interest within the wellbore upon one run-in of the pack-off system, decreasing the cost of the treatment operation.

SUMMARY OF THE INVENTION

The present invention discloses packing elements and a method for using the packing elements. The packing elements are contemplated for use as part of a pack-off system to isolate an area of interest during well treatment operations. Accordingly, the following description illustrates the packing elements of the present invention in the context of well treatment operations. It is to be understood, however, that the packing elements may be used as part of a pack-off system in other wellbore operations which require isolation of an area of interest within the wellbore.

The pack-off system is run into a wellbore on a tubular working string adjacent to the area of interest within a wellbore to be treated. The pack-off system is designed to almost seal an annular space between the pack-off system and the casing, thereby effectively isolating an area of interest within a wellbore. To this end, the pack-off system utilizes an upper packing element and a lower packing element disposed on a tubular body, with at least one perforation being disposed between the upper and lower packing elements to permit a wellbore treating fluid to be injected therethrough. After the pack-off system is run into the wellbore to the desired depth, the upper packing element is disposed above the area of interest to be treated, while the lower packing element is disposed below the area of interest to be treated, so that the packing elements thereby pack off the area of interest.

The packing elements of the present invention are designed for use with a pack-off system in which the packing elements are expanded radially by compressive force. The packing elements may be mechanically set or set with the aid of hydraulic pressure, or by combination of mechanical and hydraulic pressure. While the following description describes the packing elements of the present invention in the context of the pack-off system of U.S. Pat. No. 6,253,856 B1 for illustrative purposes, it is to be understood that the packing elements may be included in any pack-off system which uses compressive forces upon the packing elements to radially expand packing elements.

After the packing elements are set, a treating fluid is injected under pressure into the pack-off system, through the perforations in the tubular body, through the perforations in the casing, and into the surrounding wellbore. Various treating fluids may be used, including acids, polymers, and fracturing gels. The pack-off system, while the packing elements are still set within the wellbore, may then be moved to a different depth within the wellbore to treat a subsequent area of interest. Alternatively, the packing elements may be unset by relieving the pressure exerted upon the packing elements. Upon completion of the treatment operation, the pack-off system may remain permanently set in the wellbore or, alternatively, may be retrieved from the wellbore.

The present invention introduces packing elements into the pack-off system. At least two packing elements must be provided, one packing element above the area of interest, and the other packing element below the area of interest. The packing elements expand radially to effectively, but not necessarily completely, obstruct the flow of treating fluid through the annular space between the inner diameter of the casing and the outer diameter of the tubular body. The leak rate of fluid through the annular space is controlled, but not necessarily stopped. By effectively obstructing the flow of treating fluid through the annular space, the packing elements build up pressure in the area of interest so that the bulk of the treating fluid flows into the surrounding formation, thereby treating the perforations within the casing.

Each packing element of the present invention comprises overlapping leaves. The overlapping leaves are pivotally mounted on a tubular body. The leaves may be comprised of metal or high performance plastic, or any other such material that remains durable upon compression. The leaves of the upper packing element extend downward and radially outward at an angle with respect to the tubular body, while the leaves of the lower packing element extend upward and radially outward at an angle with respect to the tubular body.

In operation, the packing elements expand radially upon the exertion of compressive forces upon each element. The upper packing element is compressed to extend radially outward and downward with respect to the tubular body. The lower packing element, in contrast, is compressed to extend radially outward and upward with respect to the tubular body. It is often not necessary that the packing elements expand radially outward to an extent to completely seal the annular space between the wellbore and the tubular body to create enough pressure to treat the area of interest effectively; therefore, the packing elements of the present invention may be made of stronger, non-elastomeric material so that they exhibit increased durability over the elastomeric and inflatable packing elements. Due to the increased durability and strength of the packing elements of the present invention, treatment of multiple areas of interest in a single run-in of the tubular working string is accomplished. Furthermore, treatment of multiple areas of interest in one run-in of the tubular working string is achieved because the packing elements do not have to be set and then unset when moving the tubular working string to each different area of interest, as the packing elements do not completely seal the annular space between the casing and the tubular body.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
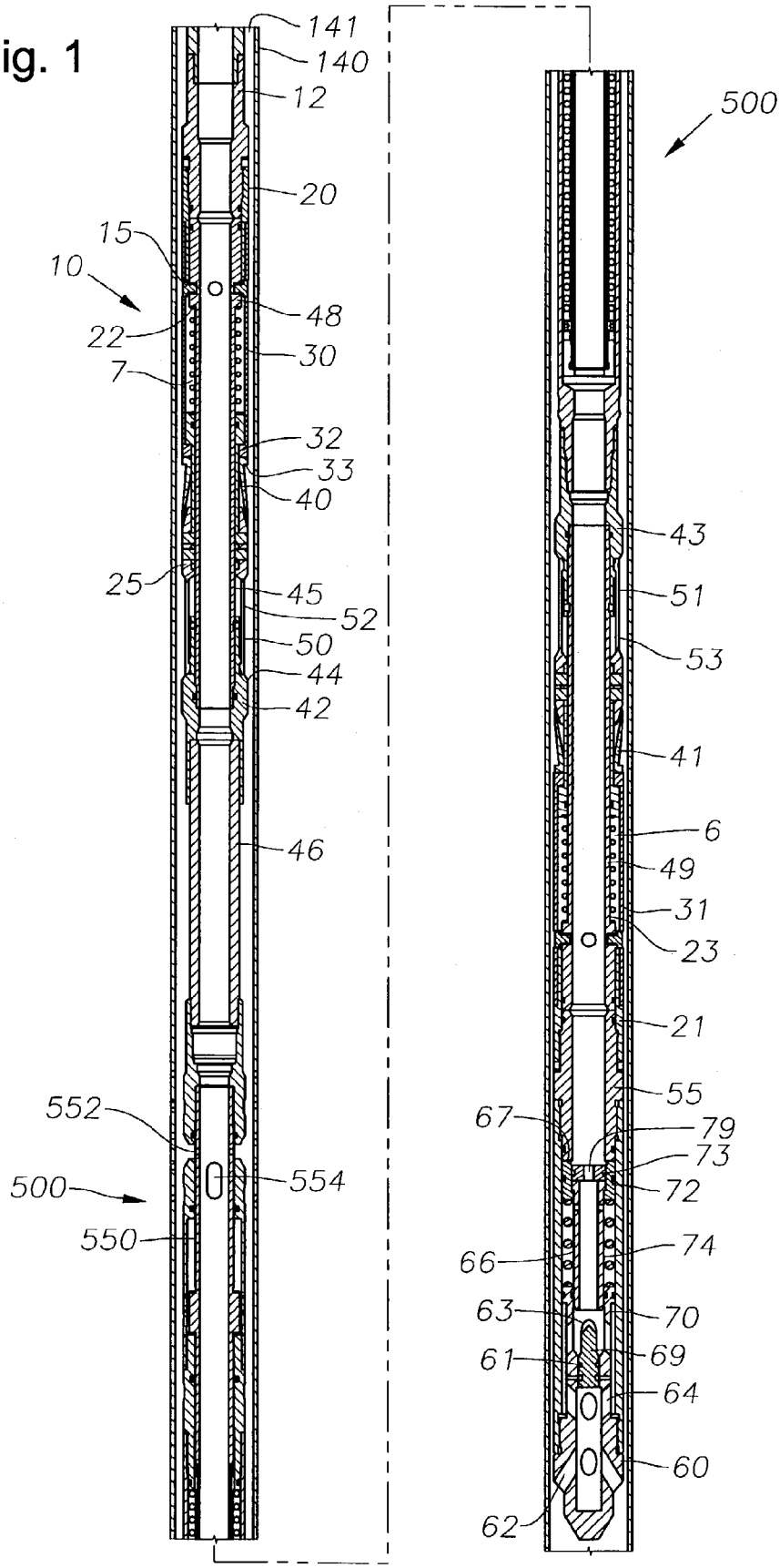
FIG. 1 is a cross-sectional view of a pack-off system which might be used with the packing elements of the present invention in a run-in configuration.
Figure 2:
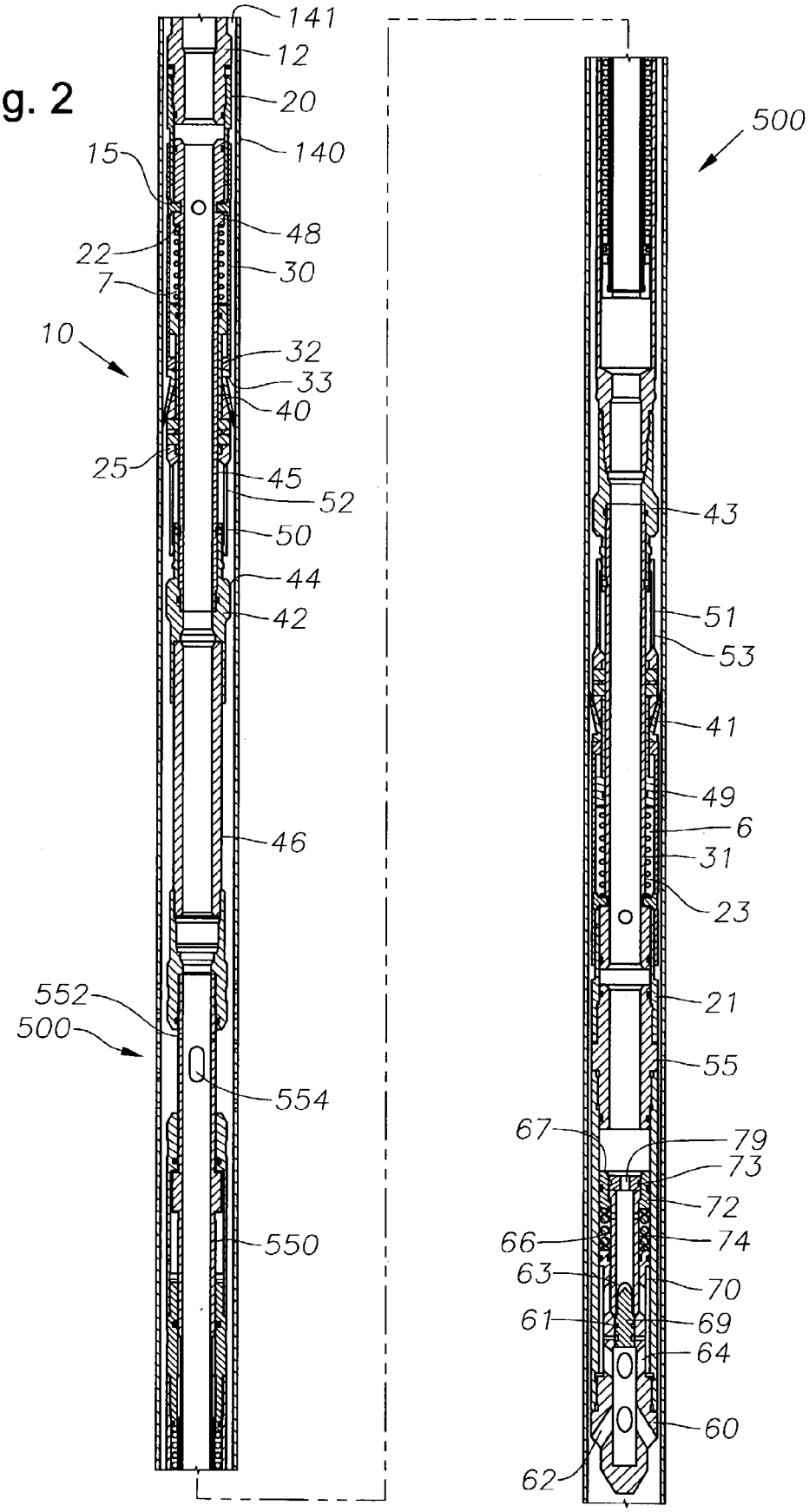
FIG. 2 is a cross-sectional view of the pack-off system of FIG. 1 with the packing elements of the present invention set in casing.

The pack-off system depicted in FIGS. 1 and 2 is merely an example of a pack-off system which might employ the packing elements of the present invention. It should be understood that any pack-off system which ultimately uses compressive force to radially expand packing elements may be used with the packing elements of the present invention, and that the pack-off system of FIGS. 1 and 2 is only illustrative.

FIG. 1 depicts a pack-off system 10 within a casing 140, where the pack-off system comprises a generally cylindrical top sub 12 with a flow bore therethrough, and where the top sub 12 is threadedly connected to a top pack-off mandrel 20 which also has a flow bore running therethrough. The top sub 12 is connected to the lower end of any tubular working string (not shown) useful for running tools in a wellbore, including but not limited to jointed tubing, coiled tubing, and drill pipe. Coiled tubing is preferable for use with the present invention.

Figure 3:
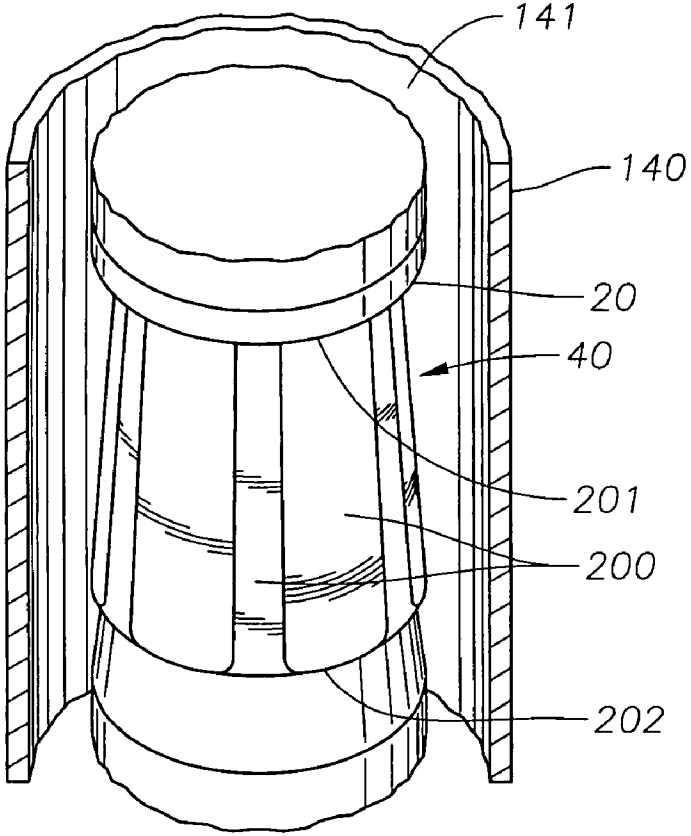
FIG. 3 is a side view of the upper packing element of the present invention in the run-in configuration.
Figure 5:
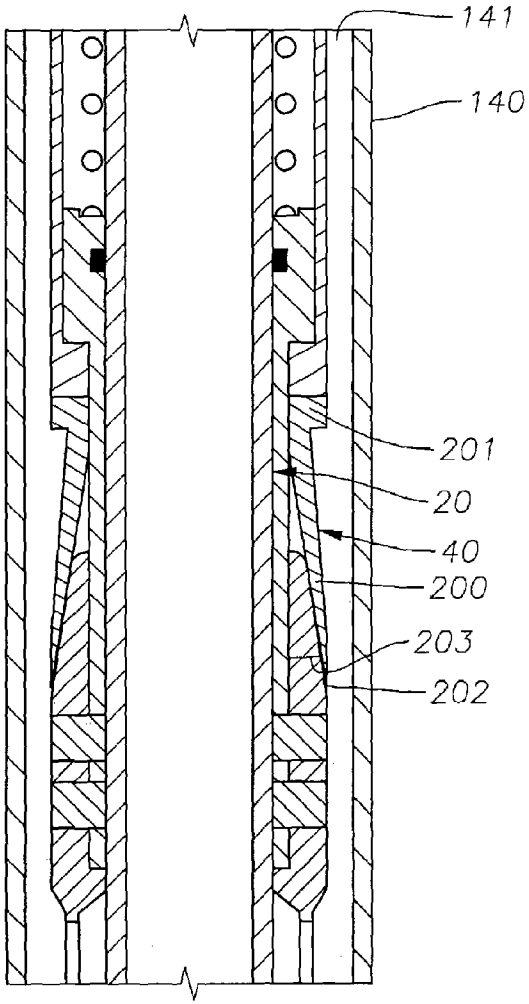
FIG. 5 is a cross-sectional view of the upper packing element of the present invention in the pack-off system of FIG. 1 in the run-in configuration.

The pack-off system 10 comprises at least two packing elements, including an upper packing element 40 and a lower packing element 41. The upper packing element 40 is disposed around a tubular body. In the pack-off system 10 shown in FIG. 1, the tubular body is the top pack-off mandrel 20. FIGS. 1, 3 and 5 show the upper packing element 40 of the present invention in the run-in configuration, where the upper packing element 40 is unactuated. The upper packing element 40 comprises a plurality of leaves 200 which overlap one another. The overlapping leaves 200 are interengaging segments which are circumferentially distributed around an outer surface of the tubular body 20 and are radially extendable. The leaves 200 may be of any shape which allows the leaves to overlap when actuated so that fluid flow through an annular space 141 is hindered. The leaves 200 may be made of any durable material, including but not limited to metal or high performance plastic. Each of the leaves 200 of the upper packing element 40 has a first end 201. The first end 201 of each of the leaves 200 is pivotally connected to the outer diameter of the top pack-off mandrel 20, so that the leaves 200 circle the top pack-off mandrel 20. Various connecting means (not shown) may be used to connect the leaves 200 to the top pack-off mandrel 20, including but not limited to pins. The leaves 200 possess a second end 202, which is opposite the first end 201 of each of the leaves 200. The leaves 200 extend radially downward at a first angle 203 from the top pack-off mandrel 20, extending through the annular space 141 and toward the casing 140.

Figure 7:
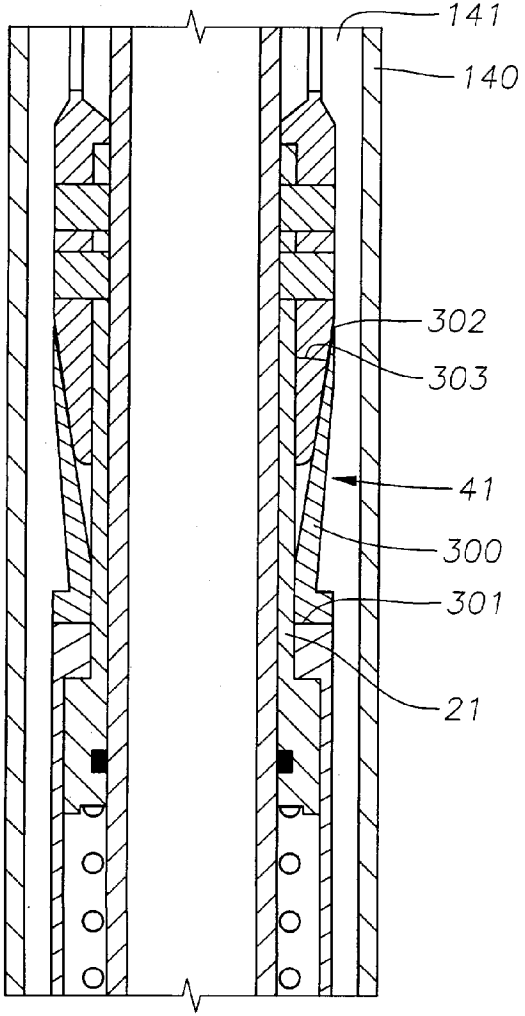
FIG. 7 is a cross-sectional view of the lower packing element of the present invention in the pack-off system of FIG. 1 in the run-in configuration.

FIGS. 1 and 7 show the lower packing element 41 of the present invention, which is disposed around a tubular body with a bore therethrough. In the pack-off system shown in FIG. 1, the tubular body is a bottom pack-off mandrel 21. The lower packing element 41 is shown in the run-in configuration, where the lower packing element 41 is unactuated. Just as shown in FIG. 3 for the upper packing element, the lower packing element 41 comprises a plurality of leaves 300 which may overlap one another. The overlapping leaves 300 are interengaging segments which are circumferentially distributed around an outer surface of the tubular body and are radially extendable. The leaves 300 may be of any shape which allows the leaves to overlap when actuated so that fluid flow through the annular space 141 is hindered. The leaves 300 may be made of any durable material, including but not limited to metal or high performance plastic. Each of the leaves 300 of the lower packing element 41 has a first end 301. The first end 301 of each of the leaves 300 is pivotally connected to the outer diameter of the bottom pack-off mandrel 21, so that the leaves 300 circle the bottom pack-off mandrel 21. Various connecting means (not shown) may be used to connect the leaves 300 to the bottom pack-off mandrel 21, including but not limited to pins. A second end 302 of each of the leaves 300 is opposite of the first end 301 of each of the leaves 300. The leaves 300 extend radially at a first angle 303 from the bottom pack-off mandrel 21, extending through the annular space 141 and toward the casing 140. Within the wellbore, the upper packing element 40 and the lower packing element 41 may be mirror images of one another, but can also have differences within the scope of this invention, as defined by the claims.

The pack-off system 10 depicted in FIG. 1 which is suitable for use with the packing elements 40 and 41 of the present invention further includes a top setting sleeve 30 and a top body 45. The top setting sleeve 30 and the top body 45 are generally cylindrical. The upper end of the top body 45 is nested within the top pack-off mandrel 20. The top setting sleeve 30 and the top body 45 are secured together through one or more crossover pins 15. The pins 15 extend through slots 22 in the top pack-off mandrel 20 so that the setting sleeve 30 and the top body 45 are moveable together with respect to the top pack-off mandrel 20 while the pins 15 are in the slots 22. In this respect, the slots 22 define recesses longitudinally machined into the top pack-off mandrel 20 to permit the setting sleeve 30 and the top body 45 to slide downward along the inner and outer surfaces, respectively, of the top pack-off mandrel 20.

The top body 45 includes a peripheral shoulder 48. Likewise, the top pack-off mandrel 20 includes a peripheral shoulder 25. The peripheral shoulder 25 of the top pack-off mandrel 20 is opposite the peripheral shoulder 48 of the top body 45. The top pack-off mandrel 20, the top body 45, and the peripheral shoulders 25 and 48 define a chamber region which houses a top spring 7 held in compression. Initially, the top spring 7 urges the top body 45 upward towards the top sub 12. This maintains a top latch 50 in a latched position with an upper bottom sub 42, thereby preventing the premature setting of the upper packing element 40.

The top setting sleeve 30 has an end 32 with a lip 33. The end 32 abuts a top end of the upper packing element 40. The lip 33 of the top setting sleeve 30 aids in forcing the extrusion of the upper packing element 40 outwardly toward the surrounding casing 140 when the upper packing element 40 is set.

The top latch 50 has a top end secured to a lower end of the top pack-off mandrel 20. Pins secure the top latch 50 to the top pack-off mandrel 20. The top latch 50 has a plurality of spaced-apart collet fingers 52 that initially latch onto a shoulder 44 of the upper bottom sub 42. The top end of the upper bottom sub 42 is also threadedly connected to the lower end of the top body 45. In this way, the upper bottom sub 42 moves together with the top body 45 within the pack-off system 10.

The parts disposed within the straddle pack-off system 10 at and above the upper bottom sub 42, which are described above, operate to actuate the upper packing element 40. Corresponding parts operate to actuate the lower packing element 41. The parts that actuate the lower packing element 41 mirror the parts that actuate the upper packing element 40. Thus, for example, the top pack-off mandrel 20 is above the upper packing element 40, while the bottom pack-off mandrel 21 is below the lower packing element 41. The following parts correspond with each other: 6 and 7, 20 and 21, 22 and 23, 30 and 31, 42 and 43, 45 and 49, 50 and 51, and 52 and 53. Parts 20 and 52 operate to actuate the upper packing element 40, while parts 53 and 21 operate to actuate the lower packing element 41.

A lower end of the bottom pack-off mandrel 21 is threadedly connected to an upper end of a crossover sub 55. The crossover sub 55 has a bore therethrough. The crossover sub 55 is used to connect the portion of the pack-off system 10 employing the packing elements 40 and 41 with a shut-off valve assembly 70.

The pack-off system 10 includes an optional spacer pipe 46. The spacer pipe 46 joins the upper packing element 40 and its associated parts (20-52) to the lower packing element 41 and its associated parts (53-21). The spacer pipe 46 has a top end which is threadedly connected to a lower end of the upper bottom sub 42. The length of the spacer pipe 46 is selected generally in accordance with the length of the area of interest to be treated within the wellbore. In addition, the spacer pipe 46 may optionally be configured to telescopically extend, thereby allowing the upper packing element 40 and the lower packing element 41 to further separate in response to a designated pressure applied between the packing elements 40 and 41.

In between the packing elements 40 and 41 is a mandrel 550 comprising a tubular body having a bore therethrough. A fluid placement port collar 500 may optionally be connected to the spacer pipe 46. FIG. 1 shows an optional fluid placement port collar 500, as described in the above-referenced co-pending application U.S. Ser. No. 10/073,685, disposed intermediate the packing elements 40 and 41. In the arrangement of FIG. 1, the top end of the fluid placement port collar 500 is threadedly connected to the lower end of the spacer pipe 46, while the lower end of the fluid placement port collar 500 is threadedly connected to the lower bottom sub 43. Packer actuation ports 552 are disposed within the fluid placement port collar 500 intermediate the upper packing element 40 and the lower packing element 41. The ports 552 place the inner bore of the pack-off system 10 in fluid communication with the annular space 141 between the outside of the pack-off system 10 and the casing 140 or wellbore (not shown). The packer actuation ports 552 are of restricted diameter to limit fluid flow into the annular region 141, aiding in the setting of the packing elements 40 and 41. Optionally, the fluid placement port collar 500 may also comprise fracturing ports 554, as described in the above-referenced application.

In the configuration shown in FIG. 1, a flow activated shut-off valve assembly 70 is provided. The assembly 70 has a housing with a bore therethrough. A nozzle 60 is threadedly connected to a lower end of the housing. The shut-off valve assembly 70 includes a piston 72 which is movable coaxially within the bore of the housing. The piston 72 has a piston body 73 which is disposed below the crossover sub 55. A diverter plug 69 is placed within the bore of the piston. The piston 72 also includes a piston member 74 which defines a restriction within the bore of the housing. A piston orifice member is disposed within the piston member 74 in order to define an orifice 79. Finally, a locking ring 67 is provided in order to hold the piston orifice member and the piston member 74 in place below the crossover sub 55.

The piston 72 is biased in its upward position. In this position, fluid is permitted to flow through the pack-off system 10 downward into the wellbore. A spring 66 may be used as a biasing member. The spring 66 has an upper end that abuts a lower end of the piston body 73. The spring 66 further has a lower end that abuts a top end of the nozzle 60. The nozzle 60 is a tubular member at the bottom of the pack-off system 10. The nozzle 60 includes outlet ports 62 which initially place the orifice 79 of the piston 72 in fluid communication with the annular region 141. Inner ports 63 and 64 provide a flow path between the orifice 79 in the piston 72 and the nozzle 60. The inner ports 63 and 64 extend through a wall 61 of the nozzle 60.

The pack-off system 10 has a fluid flow path extending between upper and lower packing elements 40 and 41 when the packing elements 40 and 41 are in the radially extended position, as depicted in FIGS. 2, 4, 6, and 8. The fluid flow path is in the annular space 141 from between a space between the upper and lower packing elements 40 and 41 to outside the space between the upper and lower packing elements 40 and 41. When at least one of the packing elements 40 and 41 is radially extended, the packing element 40 or 41 at least partially restricts the fluid flow path to outside the space between the packing elements 40 and 41. At least a portion of the fluid flows into outside the space between the packing elements 40 and 41 when the packing elements 40 and 41 restrict the fluid flow path.

In operation, the pack-off system 10 isolates an area of interest between the upper packing element 40 and the lower packing element 41 within a wellbore. The system 10 is run into the wellbore on a tubular working string. In the run-in configuration shown in FIG. 1, the leaves 200 and 300 of the upper and lower packing elements 40 and 41, respectively, are in the retracted position, and the nozzle 60 is in its open position. In this position, fluid is permitted to flow from the interior of the system 10, down through the orifice 79 of the piston orifice member, through the bore of the piston member 74, into the bore of the nozzle 60, out through the inner ports 63, into a space between the exterior of the wall 61 and an interior of the valve housing, in through the inner ports 64, and then out of the system 10 through the outlet ports 62.

The pack-off system 10 is positioned adjacent an area of interest, such as adjacent to perforations (not shown) within casing 140 or the wellbore. The pack-off system 10 is positioned so that the packing elements 40 and 41 straddle the area of interest, where the upper packing element 40 is disposed above the area of interest and the lower packing element 41 is disposed below the area of interest. Once the pack-off system 10 has been located at the desired depth in the wellbore, fluid under pressure is pumped from the surface into the pack-off system 10. In accordance with the straddle pack-off system 10 of FIG. 1, it is necessary to shut-off the flow of fluid through the bottom of the pack-off system 10 to build up enough fluid pressure to actuate the packing elements 40 and 41. The packing elements 40 and 41 are actuated when fluid flow through the valve assembly 70 is shut off. As fluid under increasing pressure is injected into the wellbore, pressure builds above the piston 72 and the orifice 79 until critical flow is reached. Actuating fluid is injected at a sufficient rate so that the pressure above the piston 72 acts to overcome the upward force of the spring 66 and to force the piston 72, including the piston member 74, downward. As the piston member 74 is urged downward by fluid pressure, the piston member 74 surrounds the diverter plug 69 and closes off inner port 63, thereby closing off the fluid flow path through the nozzle 60 and the outlet ports 62 and causing pressure to further increase.

Other arrangements for shutting off flow through the lower end of the pack-off system 10 may be used. These include the use of a dropped ball (not shown). Once the flow of fluid is shut off through the lower end of the pack-off tool 10, the lower end of the pack-off tool 10 becomes a piston end. In this respect, the pack-off tool 10 telescopes at least in accordance with the stroke length of the collar 500, thereby causing separation of the packing elements 40 and 41.

Additionally, a plug (not shown) may be lowered into the pack-off system 10 to shut off fluid flow within the pack-off system 10 to set the packing elements 40 and 41. In this embodiment, the portion of the tubular body with the lower packing element 41 thereon possesses a cut-out portion which is often termed a profile landing nipple. After the tubular working string is run into the wellbore adjacent an area of interest, a run-in string such as a wireline is used to place a plug (such as a wireline plug) within the cut-out portion of the tubular body. The wireline plug fits much like a key within the profile landing nipple, so that fluid is prevented from flowing below the plug within the tubular working string.

Regardless of the method used to stop fluid flow through the bottom of the pack-off system 10, the pressure from the trapped fluid actuates the packing elements 40 and 41. In the pack-off system 10 of FIG. 1, because the pack-off system 10 is held at the top by the supporting tubular working string, the collet fingers 52 are released over the shoulders on the upper bottom sub 43. Likewise, the collet fingers 53 are forced to release from the shoulders on the lower bottom sub 43, thus forcing the various parts between the upper packing element 40 and the lower packing element 41 to telescope apart and allowing the setting sleeves 30 and 31 to move downwardly within the corresponding pack-off mandrels 20 and 21.

Figure 4:
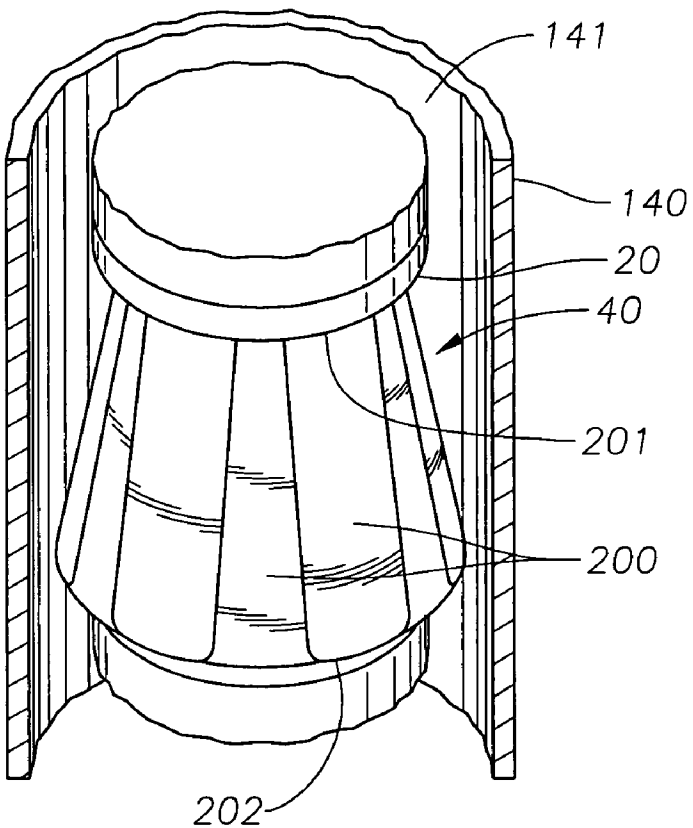
FIG. 4 is a side view of the upper packing element of the present invention, with the upper packing element set in the casing.
Figure 6:
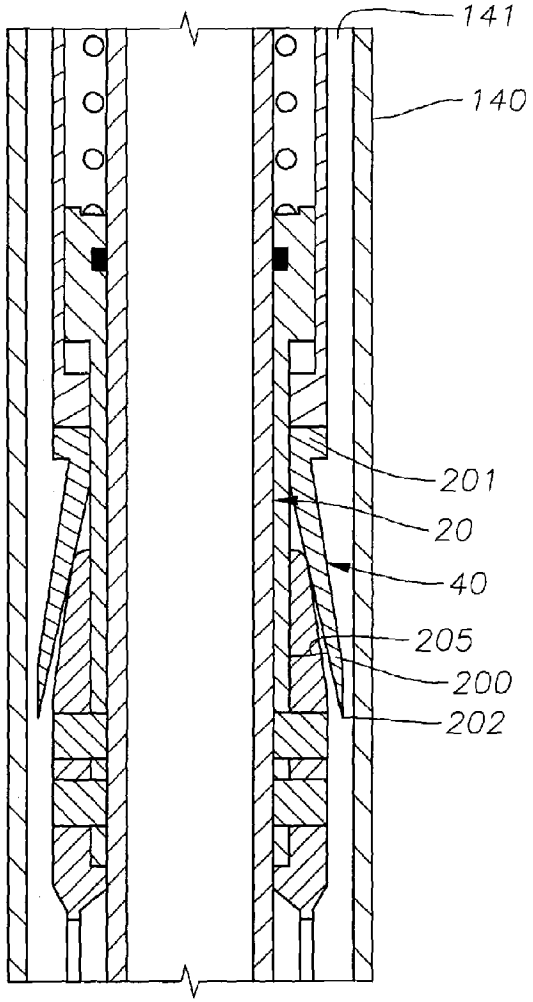
FIG. 6 is a cross-sectional view of the upper packing element of the present invention in the pack-off system of FIG. 2, with the upper packing element set in the casing.

The top setting sleeve 30 pushes down to set the upper packing element 40. Compressive force exerted by the top setting sleeve 30 and the top latch 50 upon the leaves 200 of the upper packing element 40 forces the leaves 200 to move radially outward and downward from the first angle 203 to a second angle 205. The setting of the upper packing element 40 within the casing 140 is shown in FIGS. 4 and 6. The upper packing element 40 extends radially outward from the top pack-off mandrel 20 at the second angle 205, which is greater than the first angle 203 at which the leaves 200 existed upon run-in of the tubular working string. In the set position, the leaves 200 do not touch the casing 140, but merely extend radially through the annular space 141 toward the casing 140 at the second angle 205.

Figure 8:
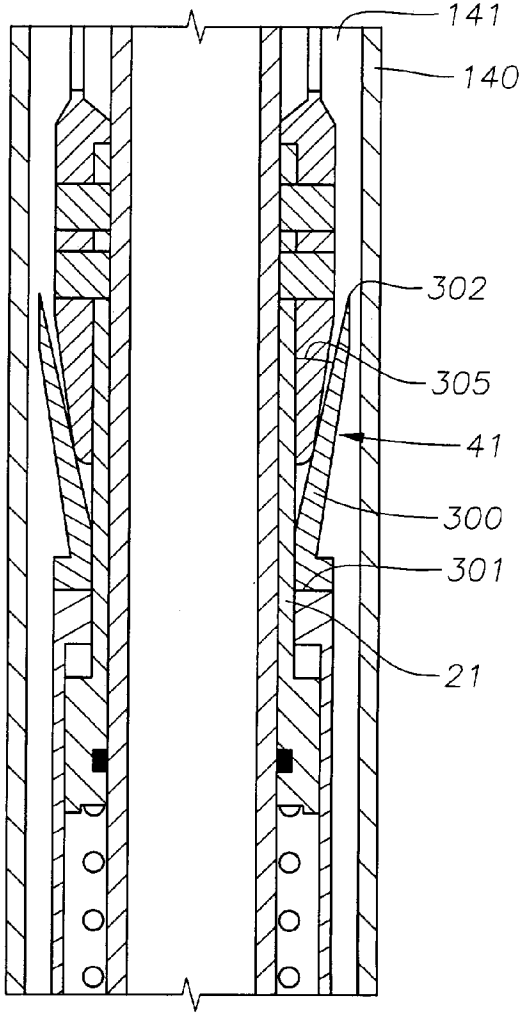
FIG. 8 is a cross-sectional view of the lower packing element of the present invention in the pack-off system of FIG. 2, with the lower packing element set in the casing.

At the same time that the upper packing element 40 is set by compressive force, the bottom latch 51 is pulled down against the lower packing element 41 so as to set the lower packing element 41. Compressive force exerted by the bottom latch 51 and the bottom setting sleeve 31 upon the leaves 300 of the lower packing element 41 forces the leaves 300 to move radially outward and upward from the first angle 303 to a second angle 305. The setting of the lower packing element 41 within the casing 140 is shown in FIG. 8, where the lower packing element 41 extends radially outward from the bottom pack-off mandrel at the second angle 305 which is greater than the first angle 303 at which the leaves 300 existed upon run-in of the tubular working string. The upper and lower packing elements 40 and 41 extend radially outward from the bottom pack-off mandrel 21 through the annular space 141 toward the casing 140 at the second angle 305, but do not touch the casing 140.

FIG. 2 shows the pack-off system 10 with the packing elements 40 and 41 set in a string of casing 140. In this figure, the pack-off system 10 is positioned adjacent an area of interest with perforations, which may be disposed in the casing 140 or in the wellbore itself. The upper packing element 40 and the lower packing element 41 are set to almost seal the annular space 141.

After sufficient pressure has been applied to the pack-off system 10 through the bore of the mandrel 550 to set the packing elements 40 and 41, fluid continues to be injected into the system 10 under pressure. Because the flow of fluid out of the bottom of the pack-off system 10 is closed off, the fluid is forced to exit the system 10 through the packer actuation ports 552 and the area between the packing elements 40 and 41. The bulk of the injected fluid is held in the area between the upper packing element 40 and the lower packing element 41. However, some of the fluid leaks through annular space between the packing elements 40 and 41 and the annular space 141, because the annular space 141 is not completely sealed by the packing elements 40 and 41. The pack-off system 10 thus acts as a dynamic isolation system. The partial obstruction caused by the upper and lower packing elements 40 and 41 increases the pressure of the fluid in the area between the two packing elements 40 and 41, forcing the bulk of the fluid to exit the pack-off system 10 through the packer actuation ports 552. An insignificant amount of fluid leaks through the annular space 141 between the second ends 202 and 302 of the leaves 200 and 300 and the casing 140. In this way, leak rate of fluid through the annular space 141 is controlled, but not completely stopped. The bulk of the fluid that is introduced into the pack-off system 10 flows into the perforations within the area of interest, but some of the fluid leaks through the annular space 141 between the second end 302 of the leaves 300 and the casing 140.

Optionally, when using the frac port collar 500 with the present invention, fluid continues to be injected into the system 10 and through the packer actuation ports 552 until a greater second pressure level is reached. This second greater fluid pressure level causes the lower packing element 41 to slip within the inner diameter of the casing 140 and to further separate from the upper packing element 40, exposing the frac ports 554 to the annular space 141. Regardless of whether the frac port collar 500 is used with the pack-off system of the present invention, a greater volume of fracturing fluid is injected into the wellbore after the packing elements 40 and 41 are set so that formation fracturing operations can be further conducted.

When sufficient fluid is injected into the wellbore to treat the first area of interest, the pack-off system 10 may optionally be moved upward or downward within the wellbore to treat a second area of interest within the wellbore. It is not necessary to remove the tubular working string from the wellbore to replace the packing elements 40 or 41. Because the packing elements 40 and 41 are not in contact with the casing 140, it is also not necessary to unset the packing elements 40 and 41 in order to move the pack-off system 10 adjacent to the second area of interest within the wellbore. Fluid is again introduced into the tubular working string and the treatment process is performed again as described above, without the need to set the packing elements 40 and 41 again. The packing elements 40 and 41 function in the same manner as described above to increase the pressure of the fluid between the packing elements 40 and 41 and force the bulk of the fluid through the perforations in the second area of interest within the wellbore. Eliminating the need to set and unset the packing elements 40 and 41 multiple times to treat multiple areas of interest allows fluid treatment operations to be accomplished in one run-in of the tubular working string. In this way, the cost of a well treatment operation is significantly decreased. At the end of the operation, the pack-off system 10 may be retrieved from the wellbore or may, alternatively, remain permanently within the wellbore.

While the foregoing is directed to embodiments of the present invention, other and further embodiments of the invention may be devised without departing from the basic scope thereof, and the scope thereof is determined by the claims that follow.

What is claimed is:

1. A method for introducing treatment fluid into an area of interest within a wellbore, the method comprising:

running a pack-off system into the wellbore, the pack-off system comprising an upper packing element and a lower packing element disposed on a tubular body;

positioning the pack-off system adjacent to the area of interest, wherein the area of interest is between the upper packing element and the lower packing element;

expanding radially the upper packing element and the lower packing element;

introducing the fluid into the pack-off system; and controlling a leak rate of the fluid through spaces between the packing elements and the wellbore.

2. The method of claim 1, wherein the controlling the leak rate of the fluid comprises controlling the introduction of the fluid.

3. The method of claim 1, wherein the tubular body comprises perforations between the packing elements through which the fluid flows after introduction of the fluid into the pack-off system.

4. The method of claim 1, wherein the upper packing element is expanded radially downward at an angle from the tubular body and the lower packing element is expanded radially upward at an angle from the tubular body.

5. The method of claim 1, wherein the packing elements comprise metal.

6. The method of claim 1, wherein the packing elements comprise high performance plastic.

7. The method of claim 1, wherein multiple pack-off systems comprising upper packing elements and lower packing elements are disposed on the tubular body to isolate multiple areas of interest.

8. The method of claim 1, wherein expanding radially the upper packing element and the lower packing element comprises injecting a fluid into the pack-off system at a pressure level sufficient to set the upper and lower packing elements.

9. The method of claim 1, further comprising:

positioning the pack-off system adjacent to a second area of interest, wherein the second area of interest is between the upper packing element and the lower packing element;

introducing the fluid into the pack-off system; and controlling a leak rate of the fluid through spaces between the packing elements and the wellbore.

10. A pack-off system for isolating an area of interest within a wellbore, comprising:

an upper packing element and a lower packing element disposed on a tubular body, wherein each packing element comprises overlapping leaves that are constructed and arranged to control a leak rate through space between the upper and lower packing elements after the packing elements are fully extended radially outward.

11. The pack-off system of claim 10, wherein the overlapping leaves are pivotally mounted on the tubular body.

12. The pack-off system of claim 10, wherein the overlapping leaves of the upper packing element extend radially downward at an angle from the tubular body and the overlapping leaves of the lower packing element extend radially upward at an angle from the tubular body.

13. The pack-off system of claim 10, wherein the overlapping leaves comprise metal.

14. The pack-off system of claim 10, wherein the overlapping leaves comprise high-performance plastic.

15. A pack-off system for increasing fluid pressure within an area of interest within a wellbore, comprising:

a tubular body;

two spaced-apart, selectively settable packing elements disposed on the tubular body for effectively sealing off the area of interest, wherein the area of interest is disposed between the two spaced-apart, selectively settable packing elements;

selectively actuable setting apparatus connected to the tubular body for selectively setting the two spaced-apart selectively settable packing elements; and a fluid flow path formable between a first area in the wellbore defined by the packing elements after they are radially extended and a second area in the wellbore defined outside the first area, wherein a portion of the fluid flow path is defined by a space between at least one of the packing elements and the wellbore.

16. The pack-off system of claim 15, wherein the selectively actuable setting apparatus is actuable by fluid under pressure introduced into the tubular body.

17. The pack-off system of claim 15, wherein the selectively actuable setting apparatus comprises at least two members moveable in response to the force of the fluid under pressure to contact each of the two spaced-apart selectively-settable packing elements and to apply compressive force to each packing element, thereby expanding each packing element radially.

18. The pack-off system of claim 15, wherein the tubular body has at least one perforation through which fluid is flowable from the inside of the pack-off system to the outside thereof.

19. A pack-off system for isolating an area of interest within a wellbore, comprising:

a tubular body, the body having a radially extendable upper packing element and a radially extendable lower packing element; and a fluid flow path formable between a first space in the wellbore defined between the upper and lower packing elements when the packing elements are fully extended radially outward and a second space in the wellbore defined outside of the tubular body and outside of the first space, wherein the fluid flow path is defined between a surface of at least one of the packing elements and the wellbore.

20. The pack-off system of claim 19, wherein the radially extendable packing elements comprise interengaging segments.

21. The pack-off system of claim 20, wherein the interengaging segments are distributed circumferentially around an outer surface of the tubular body.

22. A method for introducing treatment fluid into an area of interest within a wellbore, the method comprising:

placing at least one upper packing element and at least one lower packing element on a tubular working string;

running the tubular working string into the wellbore;

positioning the tubular working string within the wellbore wherein the upper packing element is above the area of interest and the lower packing element is below the area of interest;

injecting a fluid into the tubular working string, thereby expanding at least one of the packing elements radially and forming a portion of a fluid flow restriction proximate an inner diameter of the wellbore and a surface of at least one of the packing elements; and flowing a portion of the fluid through the restriction.

23. A method for introducing treatment fluid into an area of interest within a wellbore, the method comprising:

positioning a tubular body adjacent the area of interest, the body having a radially extendable upper packing element and a radially extendable lower packing element;

radially expanding the packing elements; and introducing the fluid into the area of interest while establishing and maintaining a leak rate of the fluid through an area defined between the packing elements and the wellbore.

* * * * *